United States Patent [19]

Middlemiss

[11] 4,413,778

[45] Nov. 8, 1983

[54] ANTIQUE LAWN PUMP MOBILE

[76] Inventor: William S. Middlemiss, 332 - 7th SE., Swift Current, Canada, S9H 3P8

[21] Appl. No.: 378,609

[22] Filed: May 17, 1982

[30] Foreign Application Priority Data

Jun. 25, 1981 [CA] Canada ..... 380635

[51] Int. Cl.[3] ..... B05B 17/08

[52] U.S. Cl. ..... 239/17; 40/406; 239/211; 417/410

[58] Field of Search ..... 222/78; D20/37; D23/13; 40/406, 407; 239/16, 17, 21-23, 211, 289; 417/316, 410

[56] References Cited

U.S. PATENT DOCUMENTS

| | | | |
|---|---|---|---|
| 1,064,873 | 6/1913 | Thowless | 40/406 |
| 2,434,771 | 1/1948 | Mueller et al. | 417/316 X |
| 2,531,002 | 11/1950 | Sisk et al. | 40/406 |

*Primary Examiner*—Andres Kashnikow

*Attorney, Agent, or Firm*—Richard J. Hicks; Stanley E. Johnson

[57] ABSTRACT

A self contained fountain in the form of an antique hand pump on a stand. A motor in the pump body oscillates the pump handle up and down and this movement alternately actuates and deactuates a submerged electric pump in the fountain reservoir so that water is pumped from the pump spout in timed relation to the movement of the pump handle. The water drains from the receiving container back to the reservoir concealed in the pump stand.

10 Claims, 1 Drawing Figure

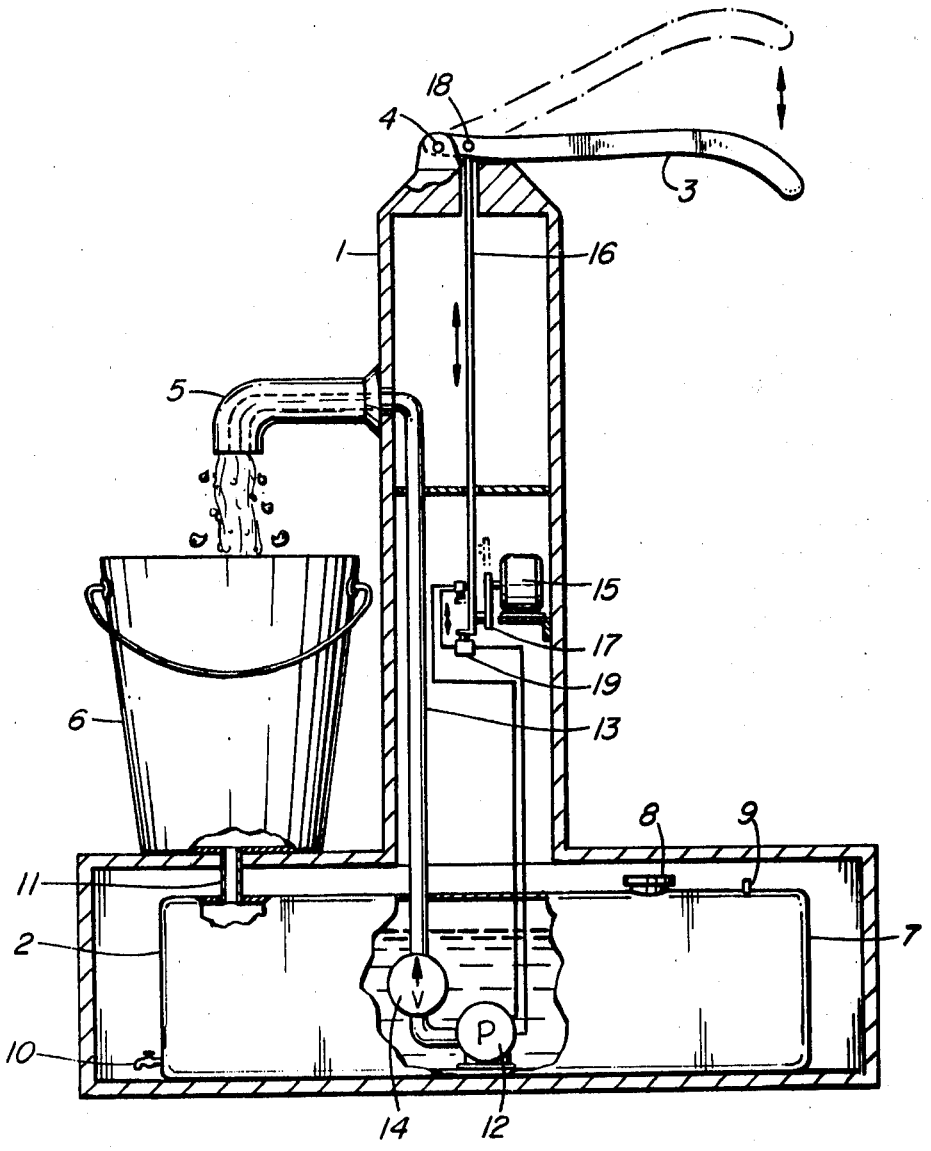
18
4
3
1
16
5
15
17
19
6
13
8
9
11
2
7
V
P
10
14
12

ANTIQUE LAWN PUMP MOBILE

This invention relates to a self contained fountain arrangement for decorative and visual display purposes.

Numerous fountain arrangements have been developed to create special and pleasing visual effects or to provide a pleasing sound of running water. Similarly hand operated lift pumps have been known for hundreds of years. Heretofore, however, there has been no attempt to create a pleasing semi-continuous fountain effect using a simulated hand operated lift pump.

An object of the present invention is to provide a semi-continuous fountain effect for display purposes from what visually appears to be a well known hand lift pump.

By one aspect of this invention there is provided a self contained fountain arrangement comprising:

(a) pump stand means including liquid reservoir means;

(b) elongate hollow pump body means mounted at one end thereof substantially perpendicularly on said stand means;

(c) pump handle means pivotally mounted, intermediate the ends thereof, on said pump body adjacent the free end thereof for oscillating movement in a plane parallel the longitudinal axis of said pump body;

(d) spout means projecting from said pump body means and spaced from said stand means;

(e) submersible pump means in said reservoir means to pump liquid to said spout means;

(f) motor means in said pump body operatively associated with said handle means so as to effect said oscillating movement; and (g) means associated with said handle means, to cyclically actuate and deactuate said pump means whereby liquid in said reservoir is pumped intermittently to said spout means in timed relation to said oscillating movement of said handle means.

The invention will be described in more detail hereinafter with reference to the drawings in which:

FIG. 1 is a side elevational view, partly in section of one embodiment of the invention.

As shown in FIG. 1 there is provided an elongated hollow pump body 1 of any convenient or selected cross sectional shape such as round or rectangular, mounted perpendicularly on a hollow stand 2, of any desired cross sectional shape, and of sufficient size to provide stability for the structure. A pump handle 3 is pivotally mounted intermediate the ends thereof about pivot 4 on the pump body 1 adjacent one longitudinal end thereof for oscillating up and down movement in conventional manner. A spout 5 projects substantially perpendicularly from body 1 at any convenient height above stand 2. A container 6 is mounted on stand 2 below spout 5 to receive water or other liquid emitted therefrom. The container 6 may be of any size or shape and is shown in FIG. 1 in the form of a simulated wooden pail with handle merely to illustrate a pleasing rustic effect; glass or other containers could equally well be used. A liquid storage tank 7 is either provided within stand 2 or hollow stand 2 is itself the liquid storage tank. Either may be equipped with such conventional parts as a filler 8, an air vent 9, and drain valve 10. A pipe 11 preferably interconnects container 6 and storage tank 7 so that liquid in container 6 can drain back into tank 7. A submersible electric pump 12 is provided in tank 7 to pump liquid contained therein via pipe 13 to spout 5 and hence into container 6. A non-return valve 14 may be provided in pipe 13 to prevent backflow of liquid.

A small motor 15, preferably but not essentially an electric motor, is mounted at any convenient location within pump body 1, and arranged to reciprocate a pump rod 16 in a direction parallel to the longitudinal axis of pump body 1 by means of any suitable and conventional motion translation means such as a crank or cam means at one end 17 of the pump rod 16. Rod 16 is pivotally connected at the other end 18 thereof to pump handle 3, and is arranged to reciprocate between a first position in which it actuates a switch means 19 interconnected between a power source (not shown) and pump 12, thereby causing pump 12 to operate and pump liquid through pipe 13 to spout 5, and a second position in which it deactuates switch means 19, thereby stopping pump 12 and the flow of liquid to spout 5. Preferably, but not essentially, pump 12 operates during that part of the cycle in which the pump handle moves, under the action of motor 15 and rod 16, from an "up" position to a "down" position, and is inoperative as the pump handle moves in the reverse direction, thereby simulating the conventional hand lift pump action.

As liquid flows from spout 5 it falls, under gravity into container 6 and drains back into container 7 for recirculation. It will, of course, be appreciated that if recirculation is not desired, a container without drain 11 may be substituted under spout 5 and the pump merely actuated until all liquid contained in tank 7 has been dispensed. The present pump arrangement is, therefore, suitable for use not only as a recirculating ornamental fountain but also as a novelty dispenser for liquids such as liquor or soft drinks.

I claim:

1. A self contained fountain arrangement comprising:

(a) pump stand means including liquid reservoir means;

(b) elongate hollow pump body means mounted at one end thereof substantially perpendicularly on said stand means;

(c) pump handle means pivotally mounted, intermediate the ends thereof, on said pump body adjacent the free end thereof for oscillating movement in a plane parallel the longitudinal axis of said pump body;

(d) spout means projecting from said pump body means and spaced from said stand means;

(e) submersible pump means in said reservoir means to pump liquid to said spout means;

(f) motor means in said pump body operatively associated with said handle means so as to effect said oscillating movement; and (g) means, associated with said handle means, to cyclically actuate and deactuate said pump means whereby liquid in said reservoir is pumped intermittently to said spout means in timed relation to said oscillating movement of said handle means.

2. A fountain arrangement as claimed in claim 1 including container means arranged on said stand means to receive liquid issuing from said spout means.

3. A fountain arrangement as claimed in claim 2 including liquid passage means between said container means and said reservoir to recirculate said liquid from said container to said reservoir.

4. A fountain arrangement as claimed in claim 1, wherein said motor means is an electric motor.

5. A fountain arrangement as claimed in claim 1, wherein said pump means is an electric pump.

6. A fountain arrangement as claimed in claim 1, wherein said pump means is an electric pump and said actuating means is a switch means connected between said pump and a power source.

7. A fountain arrangement as claimed in claim 1, including rod means pivotally mounted at one end thereof to said handle means and operatively connected at the other end thereof to said motor means.

8. A fountain arrangement as claimed in claim 1, including rod means pivotally mounted at one end thereof to said handle means and connected at the other end thereof to said motor means by a crank means.

9. A fountain arrangement as claimed in claim 1, including rod means pivotally mounted at one end thereof to said handle means and connected at the other end thereof to said motor means by cam means.

10. A fountain arrangement as claimed in claim 1, wherein said pump means includes a non-return valve between said pump and said spout means.

* * * * *